United States Patent [19]

Kinney

[11] 4,372,384

[45] Feb. 8, 1983

[54] WELL COMPLETION METHOD AND APPARATUS

[75] Inventor: Charles W. Kinney, Houston, Tex.

[73] Assignee: GEO Vann, Inc., Houston, Tex.

[21] Appl. No.: 188,813

[22] Filed: Sep. 19, 1980

[51] Int. Cl.[3] ..... E21B 33/124; E21B 43/04

[52] U.S. Cl. ..... 166/278; 166/51; 166/297; 166/319; 175/4.52; 175/4.56

[58] Field of Search ..... 166/51, 278, 276, 297, 166/298, 227, 191; 175/4.56, 4.6, 4.52

[56] References Cited

U.S. PATENT DOCUMENTS

| | | | |
|---|---|---|---|
| 2,452,654 | 11/1948 | Hayes et al. | 166/278 |
| 2,876,843 | 3/1959 | Huber | 175/4.56 |
| 3,062,284 | 11/1962 | Brown | 166/278 |
| 3,455,387 | 7/1969 | Peters | 166/278 |
| 3,706,344 | 12/1972 | Vann | 166/55 X |
| 3,710,862 | 1/1973 | Young et al. | 166/278 |
| 3,850,246 | 11/1974 | Despujols | 166/278 |
| 3,913,676 | 10/1975 | Barbee, Jr. et al. | 166/278 |
| 3,939,927 | 2/1976 | Bohn | 166/297 |
| 3,952,804 | 4/1976 | Smyrl | 166/278 |
| 3,963,076 | 6/1976 | Winslow | 166/278 |
| 3,987,854 | 10/1976 | Callihan et al. | 166/278 |
| 4,049,055 | 9/1977 | Brown | 166/278 |

*Primary Examiner*—Stephen J. Novosad

*Attorney, Agent, or Firm*—David A. Rose; Murray Robinson; Ned L. Conley

[57] ABSTRACT

Method and apparatus for completing a highly unconsolidated formation located downhole in a cased borehole in one trip. A tool string is run downhole into the borehole on the end of a tubing string. The tool string includes a perforating gun, a gravel packing tool, and packer means. The gravel packing tool includes a removable mandrel and a sand screen. The casing is perforated by running a gun firing device down through the tubing string and mandrel, and the well is free flowed to clean up the perforated formation. The sand screen is next positioned near the perforations and the packer means employed at each end of the screen to straddle and pack-off the perforated pay zone. The mandrel is then manipulated to form an isolated flow path which extends from the surface of the ground into the annulus behind the screen, and then back uphole from the screen to the casing annulus located between the tubing string and the casing, so that gravel admixed with fluid can flow down the tubing string into the screen annulus where the gravel separates from the fluid. The carrier fluid returns through the screen, back up through the tool string, into the casing annulus, and to the surface of the ground. The tool string is left downhole in the borehole as a permanent completion device. Produced fluid flows through the perforations, through the gravel and sand screen, and back uphole through the tubing string.

43 Claims, 10 Drawing Figures

WELL COMPLETION METHOD AND APPARATUS

BACKGROUND OF THE INVENTION

Permanent completion devices for cased wellbores are known to those skilled in the art, as evidenced by U.S. Pat. No. 3,706,344 to R. R. Vann. Some boreholes extend through a highly unconsolidated hydrocarbon bearing formation which causes sand to be produced therefrom along with the hydrocarbons. The continuous production of sand is undesirable because of the deleterious effects upon the downhole equipment as well as causing above ground problems with the gathering system. Reference is made to U.S. Pat. No. 4,009,757 which further discusses this problem.

In order to overcome many of the problems associated with the production of sand, those skilled in the art have employed various different techniques for "gravel packing" the pay zone. Gravel packing of a well generally includes positioning a cylindrical sand screen downhole in the borehole adjacent to the perforated zone, and straddling the perforations with packer devices so that an annular area is isolated behind the screen and between the packers. Gravel is packed into the annular area. The gravel packed zone prevents sand from flowing through the perforations and into the borehole.

In order to perforate an unconsolidated zone, and thereafter to gravel pack the zone, it has heretofore been customary to make several trips into the well. Generally, the casing is perforated with a casing gun as set forth, for example, in U.S. Pat. No. 4,140,188 and 3,717,095. The perforating gun is then removed from the borehole and a suitable gravel packing tool string run downhole and positioned adjacent to the perforations. An example of a gravel packing tool is set forth on pages 349–354 of Baker Oil Tools 1974–75 catalog; 7400 E. Slauson Ave; Los Angeles, California 90040. Gravel is flowed downhole to the tool and into the annular area between the screen and the perforations, with some of the gravel flowing back into the perforations and into the unconsolidated zone, thereby reinforcing the unconsolidated zone and preventing the production of sand therefrom, while at the same time, minute passageways are left through which the produced hydrocarbons can flow into the cased borehole.

The above operation generally is carried out after the casing has been cemented into place, and before the drilling or work-over rig is moved off location. In any event, several different trips into the borehole are required, each of which represents a considerable amount of time, cost and effort. It would therefore be desirable to be able to make a single trip into a borehole with a tool string, and to use the tool string to perforate the pay zone and subsequently gravel pack the perforated zone before coming out of the hole. Method and apparatus for completing a well in a single trip into the borehole is the subject of the present invention.

SUMMARY OF THE INVENTION

This invention teaches a method for permanently completing an unconsolidated formation located downhole in a borehole. In particular, the invention describes both method and apparatus by which an unconsolidated formation can be permanently completed by making a single trip into the borehole.

The method of the invention is carried out by running a tool string comprised of a perforating means and gravel packing tool into the borehole on the end of a tubing string. The tubing string can be drill tubing, production tubing, or other suitable tubing apparatus. The gravel packing tool includes a main body within which there is formed a sand screen, a packer device located at each end of the main body, and a concentrically arranged mandrel axially received in a telescoping manner within the main body. The mandrel is manipulated by the tubing string to form various different flow passageways.

One passageway extends to the perforating means. Another passageway extends to one side of the sand screen. Still another passageway extends to the other side of the screen.

The perforating means preferably is a jet perforating casing gun. The gun is located adjacent to the unconsolidated hydrocarbon containing formation, the casing is perforated, and then the sand screen is moved into a position adjacent to the perforated zone. The packers are next set to provide an annular area between the perforated casing and the screen, and an annular area between the tubing string and the unperforated casing. The tool is manipulated to form the first passageway which extends down through the tubing string into the screen annulus and from the screen back into the casing annulus and uphole to the surface of the ground. Gravel entrained in a suitable fluid is pumped down through the tubing string and into the screen annulus where the gravel is packed behind the screen. The screen separates the gravel from the carrier fluid so that the fluid is free to flow across the screen, up into the casing annulus, and back uphole to the surface of the ground. The tool is next manipulated into the production configuration whereupon formation fluid flows through the perforations, through the gravel and screen, and up the tubing string, thereby completing the well in a single trip.

In one embodiment of the invention, an axial flow path is formed from the tubing string, axially through the cylindrical screen assembly, and to a gun firing head so that the gun can be actuated by running a gun actuating device from the surface down through part of the tool string and into contact with the gun firing head in order to detonate the gun.

In another embodiment of the invention, a vent string is provided between the gun and the screen so that the borehole can be opened to atmospheric pressure at the instant of perforation, thereby cleaning up the well by utilizing the principal of surging.

In another embodiment of the invention, a perforation washer is utilized to form cavities between adjacent perforations after the gun has been detonated and prior to the gravel packing step, so that a substantial quantity of gravel can be forced back beyond the perforations and into the pay zone.

In still another embodiment of the invention, a dual packer is employed with a sand screen and casing gun being disposed below the dual packer, so that one tubing string can be used to pump gravel behind the screen while the other tubing string is used for return fluid flow. Thereafter, production is achieved through the tubing string which is used for return fluid flow.

Accordingly, a primary object of the present invention is the provision of method and apparatus by which a pay zone located downhole in a cased borehole can be permanently completed in a single trip into a borehole.

Another object of the invention is to provide the method of perforating a casing, gravel packing the perforated zone, and completing the well in a single trip into the borehole.

A further object of this invention is to disclose and provide a method of perforating, gravel packing, and producing a pay zone located downhole in a borehole by making a single trip into the wellbore.

A further object of this invention is to provide both method and apparatus for perforating a pay zone located downhole in a cased borehole, gravel packing the perforated zone, and thereafter producing the well through the gravel packed area.

Another and still further object of the present invention is the provision of apparatus by which a cased borehole is perforated adjacent to a pay zone, a cavity is formed within the pay zone and between the perforations, the pay zone is gravel packed, and the well is produced through the gravel packed portion of the borehole.

An additional object is the provision of a method of forming high density perforations within the casing of a borehole, gravel packing the perforated zone, and forming a passageway from the zone to the surface of the ground so that a highly unconsolidated zone can be permanently completed by making a single trip into the borehole.

These and various other objects and advantages of the invention will become readily apparent to those skilled in the art upon reading the following detailed description and claims and by referring to the accompanying drawings.

DETAILED DESCRIPTION OF THE PREFERRED EMBODIMENTS

Figure 1:
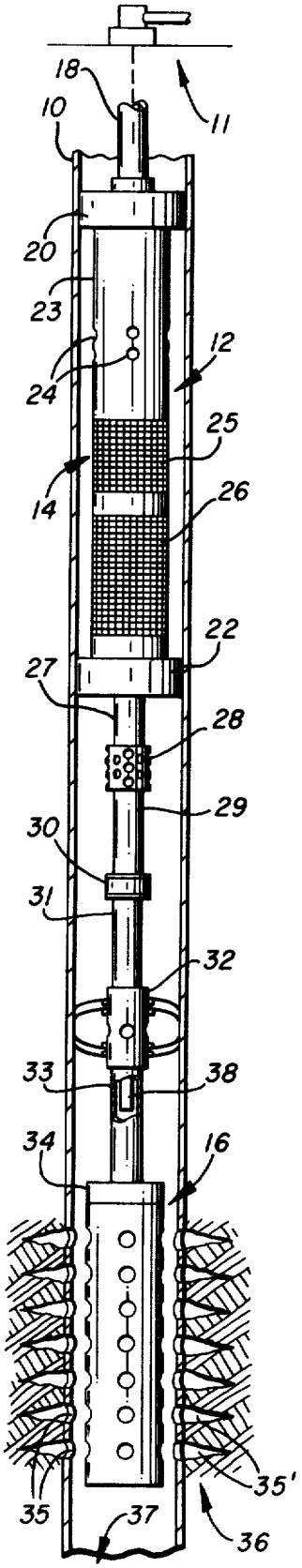
FIG. 1 is a part diagrammatical, part schematical, part cross-sectional fragmentary view of a cased borehole having a tool string made in accordance with the present invention associated therewith.

FIG. 1 of the drawing discloses a cased borehole 10 which extends downhole from the surface 11 of the ground. A tool string 12 made in accordance with the present invention is located therewithin. The tool string includes a gravel packing tool 14 and a casing perforating means 16 connected together in series relationship, and supported from a tubing string 18.

Packer means, preferably in the form of an upper packer 20 which is spaced from a lower packer 22, forms part of the gravel packing tool. The tool includes a main body 23, which is preferably cylindrical in form, and which is provided with outflow ports 24 through which gravel of a predetermined size can flow. A sand screen 25 and 26 underlies the ports and is located between the two spaced packers. The screen can be of any number and length. Sub 27, which can be in the form of a nipple, supports the perforating means 16 in underlying relationship respective to the gravel packing tool. A vent assembly 28, such as seen in U.S. Pat. No. 3,871,448, 3,931,855, or 4,040,485, for example, is interposed above a releasable coupling 30, as seen, for example, in U.S. Pat. No. 3,966,236 or 4,066,282. The coupling is connected to a perforation washer 32, the details of which are more fully set forth in FIG. 7 of the drawing. Nipples 29, 31 and 33 are similar to nipple 27. The use of members 28, 30 or 32 is considered to represent sub-combinations of this invention.

The perforating means 16 preferably is made in accordance with one of the before cited patents, and includes a gun firing head 34 connected to actuate or fire the illustrated shaped charges of the gun in such a manner that when the gun firing head is actuated, the shaped charges of the perforating gun forms perforations 35 within the casing, and tunnels 35' leading back up into the pay zone 36. The pay zone usually is a hydrocarbon containing formation, and in particular, a highly unconsolidated formation which produces sand. The perforations 35 are of a size to pass gravel which may flow through ports 24. The before mentioned screen 25 and 26 is of a size which precludes the flow of the gravel therethrough. A rat hole 37 is a continuation of the borehole and usually extends a sufficient depth to accommodate all of the tool string located below the packer 22 therewithin, so that the entire tool string can be lowered into the illustrated position of FIG. 2.

In FIG. 1, perforating actuating means 38, preferably in the form of a bar, has been moved through the tubing 18, through the gravel packing tool 14, and into abutting engagement with the gun firing head 34, thereby detonating the individual shaped charges and forming perforations 35. The illustrated shaped charges of FIG. 1 are shown in the act of being fired.

Figure 2:
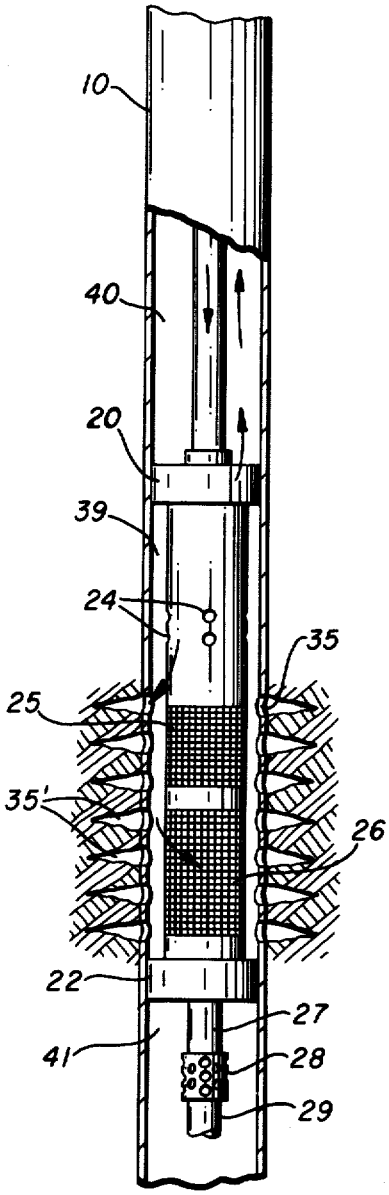
FIG. 2 is similar to FIG. 1 and illustrates the apparatus of the present invention in a different mechanical configuration.

As seen in FIG. 2, the gravel packing tool has been lowered by manipulating tubing string 18 until the spaced apart packer devices 20 and 22 straddle the perforated zone, thereby placing the screen adjacent to the perforated pay zone and providing a screen annulus 39 for containing gravel, a casing annulus 40 for return fluid flow, and a lowermost isolated zone 41 within which the used perforating gun may be stored.

FIG. 2 also illustrates that the tubing 18 has been manipulated in a manner to set the packers 20 and 22, thereby isolating the pay zone with the screen and packers. Accordingly, gravel admixed with a suitable carrier fluid can be circulated down through the tubing string 18, through the gravel flow ports 24, into the screen annulus 39, where the gravel is deposited behind the screen and within the annulus, with some of the gravel being forced back through the perforations and into the cavities 35' formed within the pay zone 36. The carrier fluid is separated from the gravel as the fluid flows through the screens 25 and 26. The fluid flows up through a passageway of the tool, through the upper packer 20, and into the casing annulus 40, where it is free to flow uphole to the surface of the earth. The details of the various passageways are more fully set forth later on.

Figure 8:
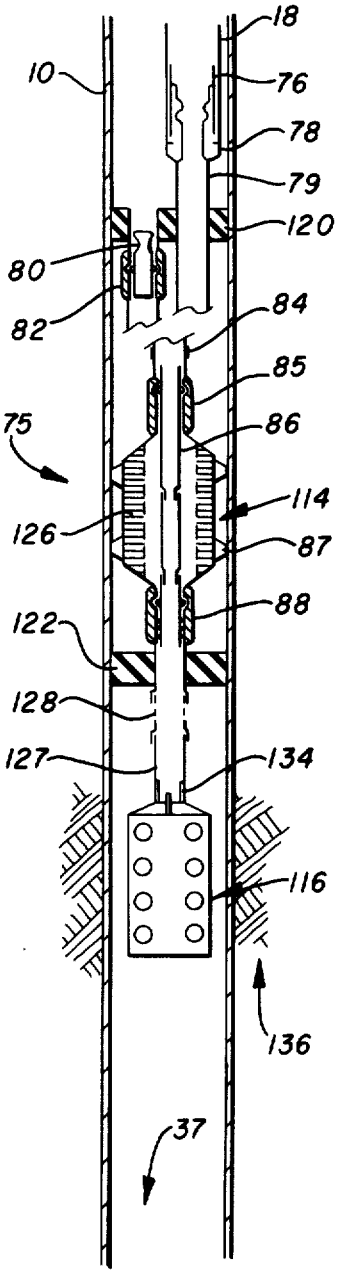
FIG. 8 is a longitudinal cross-sectional view which schematically sets forth another embodiment of the present invention; and, FIGS. 9 and 10 are similar to FIG. 8, and show the apparatus thereof in a different operative configuration.
Figure 9:
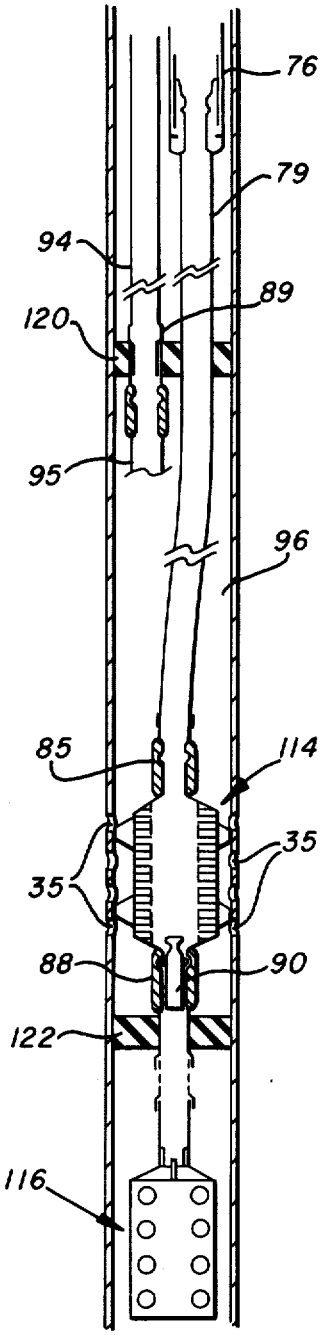
Figure 10:
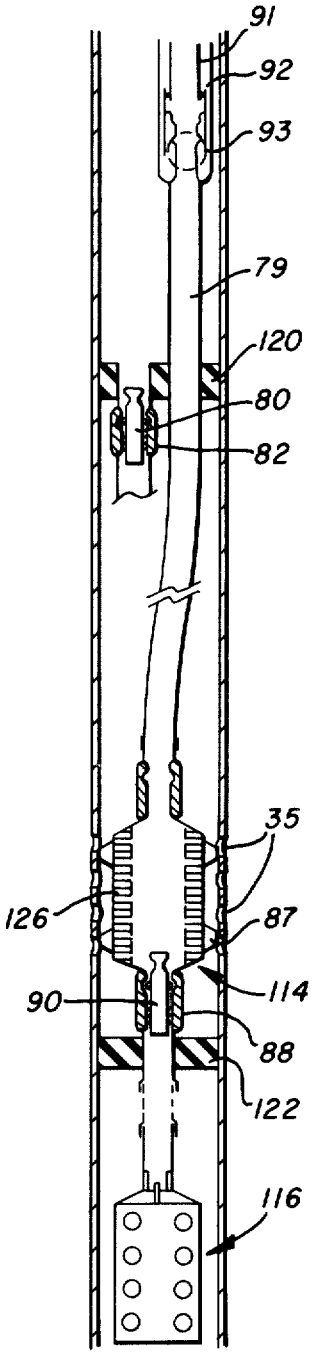

The tubing string 18 is next manipulated to close the gravel and return flow paths, and to form a production flow path from the screen and into the tubing string 18 so that production fluid can flow from the formation 36, through the perforations, through the gravel pack, through the screen, and uphole through the tubing string 18 to the surface of the ground. The embodiments of the invention disclosed in FIGS. 3–6 and in FIGS. 8–10 illustrate diverse forms of the gravel packing tool 14 which achieve the foregoing method.

Figure 3:
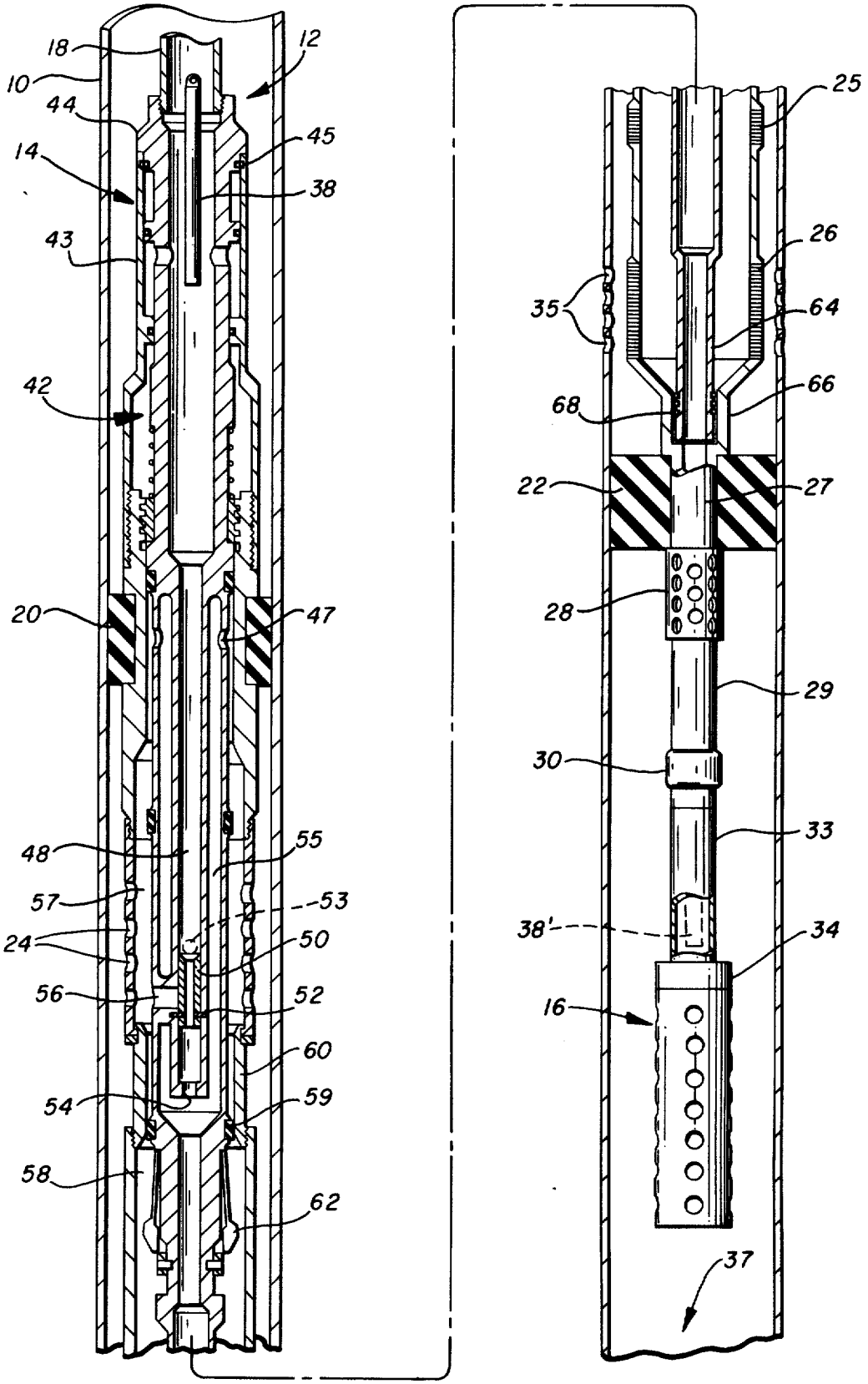
FIG. 3 is an enlarged, longitudinal, part cross-sectional, more detailed representation of the apparatus disclosed in FIGS. 1 and 2.

FIG. 3, together with other figures of the drawing, illustrates the gravel packing tool in the set position prior to the gravel pack operation. A removable mandrel 42 is telescopingly received within a housing 43, hereinafter also referred to as the "outer barrel". The upper marginal end 44 of the mandrel sealingly engages the upper end of the outer barrel at seal means 45. A releasable fastener 46 releasably engages the mandrel respective to the outer barrel. The axial passageway 48 extends from communication with the tubing string 18, down through a hollow sliding sleeve assembly 50. The sleeve is reciprocatingly received in a slidable manner within the reduced diameter portion of the mandrel axial passageway 48. The sleeve is releasably affixed to the passageway by means of shear pins 52. A ball 53 can be circulated down onto the illustrated seat formed at the upper end of the sleeve. Shoulder 54 circumferentially extends inwardly of the passageway and forms a cage for catching the sleeve and ball, thereby closing the lowermost end of the axial passageway, in the illustrated manner of FIGS. 3 and 4.

Figure 4:
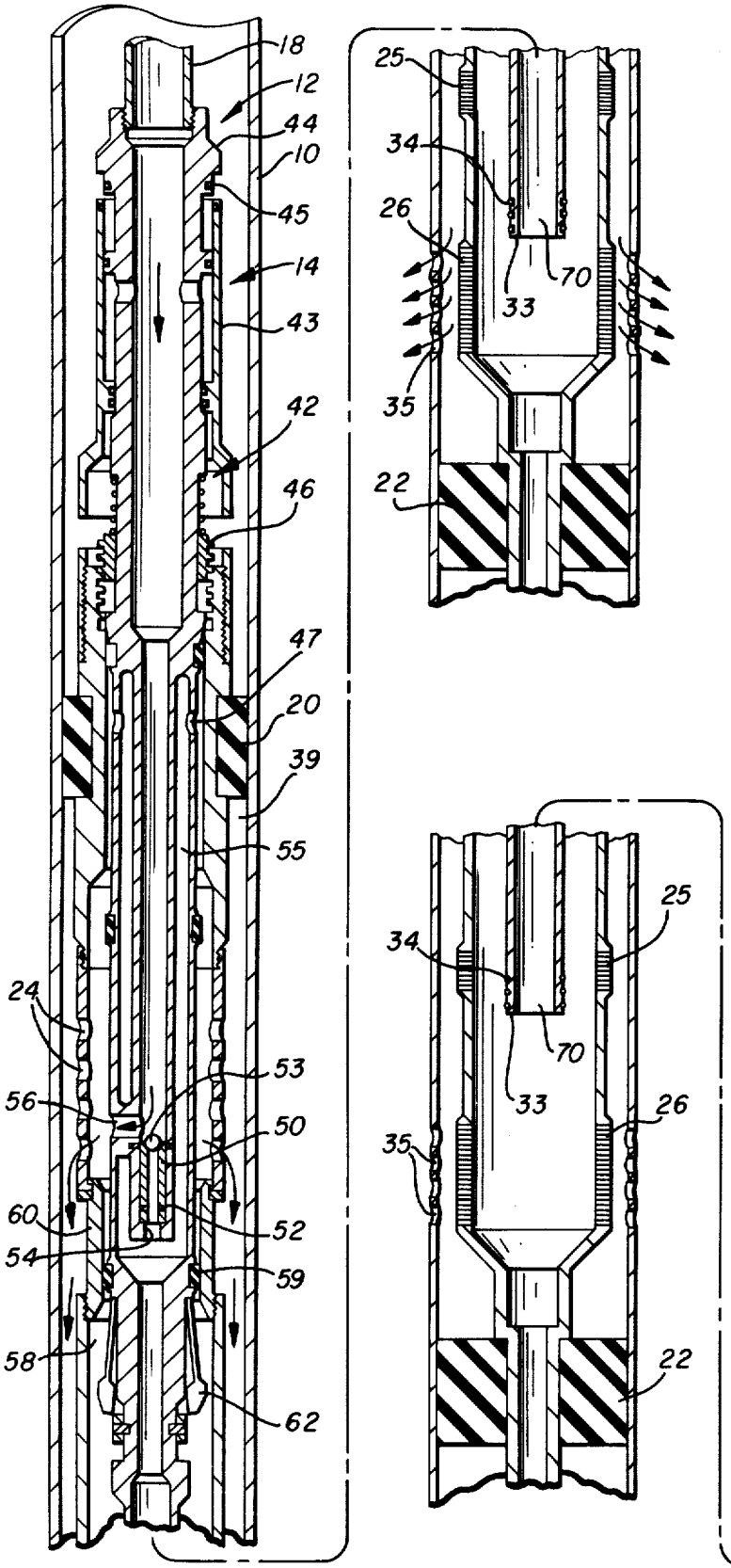
FIGS. 4, 5, and 6 are similar to FIG. 3, with the apparatus being shown in various alternant operative configurations.

In FIG. 3, a gravel flow port 56 is normally closed by the sleeve, and can be opened to communicate annulus 57 with the axial passageway 48, as seen in FIG. 4, wherein the before mentioned gravel outlet ports 24 communicate annulus 57 with the screen annulus, thereby establishing a passageway which extends from the tubing string, through the mandrel, and into the screen annulus.

Figure 5:
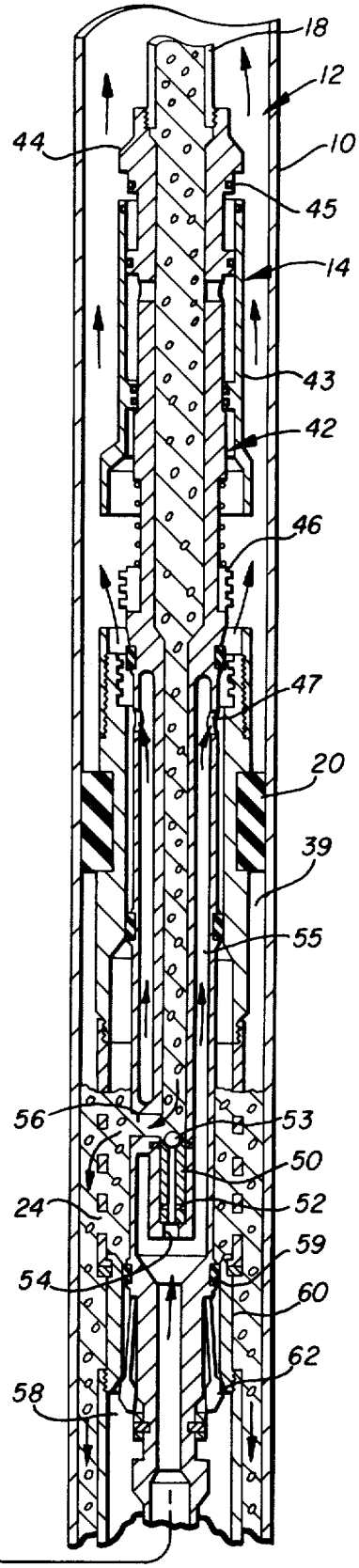

In FIG. 3, the lower marginal length of the mandrel forms an annulus 58 respective to the interior of the screen. Seal means 59 sealingly engages a seating nipple 60 to separate annulus 57 from annulus 58. Position indicator 62 extends radially outwardly to a diameter which is greater than the inside diameter of the seating nipple. The indicator includes arms which are forced radially inwardly when the mandrel is lifted in an upward direction respective to the outer barrel, thereby giving a visual weight indication above ground that the mandrel has been shifted axially uphole into one of its alternate positions, such as illustrated in FIG. 5.

The lower marginal end of the mandrel is reduced in diameter to form the illustrated washpipe 64. The lower end of the outer barrel is attached by any convenient means to the lower packer and to the nipple 27. Seal 68 forms a sliding seal at the interface formed between the washpipe and the circumferentially extending inside surface area of the reduced diameter portion 66 of the outer barrel.

Accordingly, with the mandrel in the illustrated position of FIG. 3, a gum firing passageway is formed from the interior of tubing string 18, down through the upper packer, concentrically through the screen, through the lower packer, and to the firing head of the perforating means. The before mentioned bar 38 can therefore be passed from the surface of the earth, down through the tubing string 18, through the axial passageway of the mandrel, and down to the gun firing head where the bar impacts against the firing head as indicated by the dot-dashed line at numeral 38', thereby detonating the shaped charges of the gun and forming the perforations 35 within the casing.

Vent assembly 28 is opened upon the setting of the lower packer. Accordingly, at this time, hydrocarbons from the pay zone are free to flow into the opened vent assembly, into the axial passageway of the mandrel, into the tubing string 18, and uphole to the surface of the ground, thereby cleaning up the perforations by surging the well to ambient.

The well is next shut in, the ball 53 is dropped downhole onto the sliding sleeve 50, and the upper packer is set hydraulically. Lower packer 22 preferably should have already been mechanically set. Pressure effected within tubing 18 shears pins 52 and forces the sliding sleeve into the illustrated position of FIG. 4. This forms a flow path from the tubing 18 into the screen annulus, hence, the tool can be used in the configuration of FIG. 4 in order to carry out any well treatment involving acidizing, proping agents, and the like.

The mandrel is next disengaged from the upper end of packer 20 and lifted into the illustrated position of FIG. 5. This action forms a flow path from the surface of the ground, through the tubing string, through port 56, through gravel flow ports 24, and into the annulus 39; and a return fluid flow path from the screen, into the lower end of the mandrel, along the bypass passageway 55, and through ports 47 into the casing annulus. Gravel entrained with a suitable fluid, such as water or air, flows along this flow path where the gravel is packed within the screen annulus. Separated carrier fluid flows through the screen, into the lower end 70 of the washpipe, up through the passageway 55, through the tubing string, and to the surface of the ground.

A suitable rise in pressure differential of the gravel mixture indicates that sufficient gravel has been packed behind the screen. At this time the mandrel is lifted into the illustrated position of FIG. 6, and reverse circulation washes the gravel from the hole. This last step is carried out by flowing a suitable fluid down the casing annulus, through port 56, and up the passageway 48.

Figure 6:
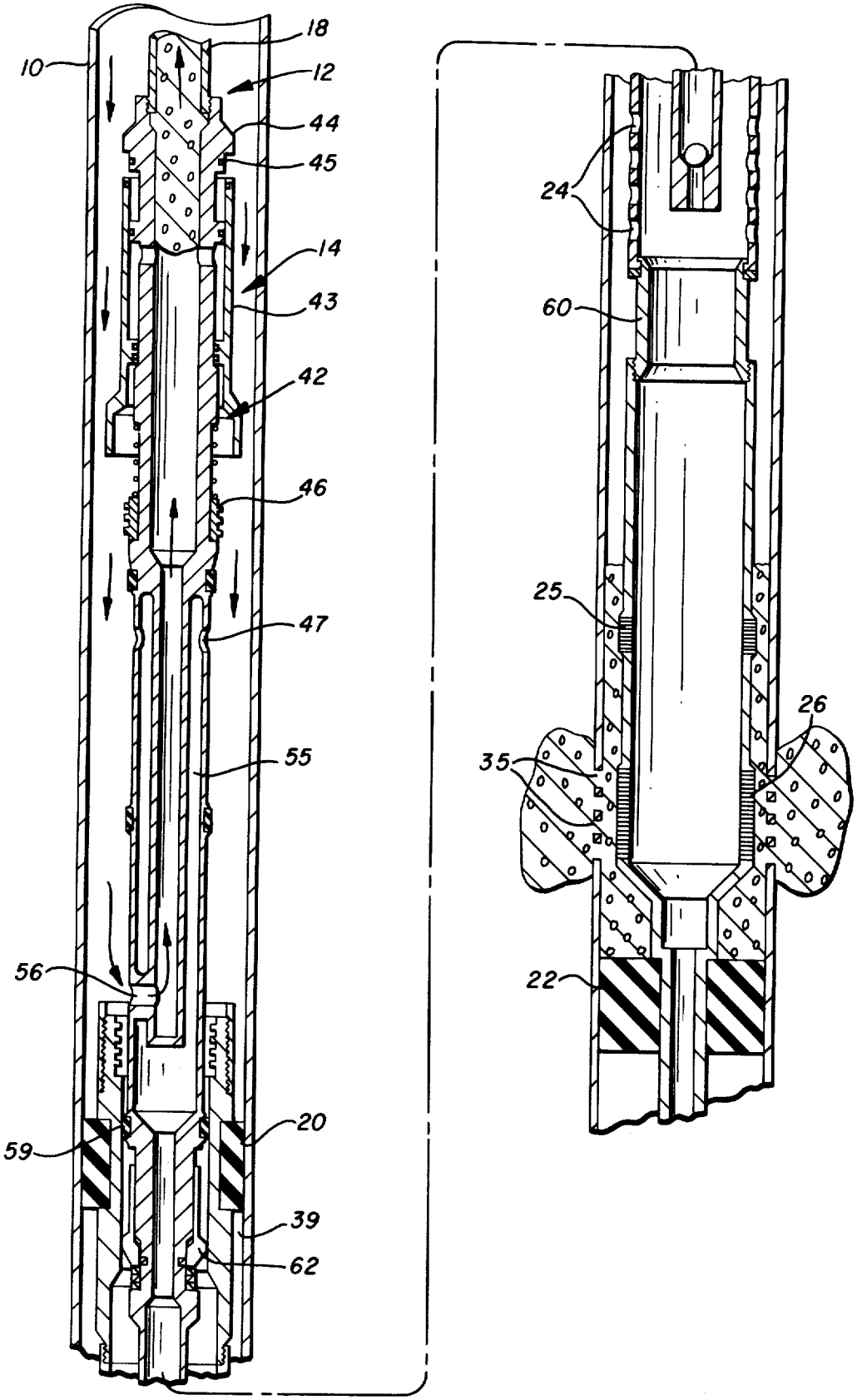

Hence, FIG. 3 illustrates the configuration of the tool for the perforation step; FIG. 4 illustrates the configuration of the gravel packing tool wherein an acidizing treatment can be carried out; FIG. 5 is the configuration of the tool for pumping gravel down behind the screen; and FIG. 6 is the configuration of the tool for cleaning the unused gravel from the wellbore.

Often tubing string 18 will be a drill string or the like which will be subsequently removed from the borehole. In this instance, the mandrel is lifted from the remainder of the tool string, and a production tubing connected at the fastener 46, thereby completing the well in a permanent manner. If deemed desirable, the releasable coupling can be wireline actuated to drop the gun to the bottom of the rat hole.

In FIG. 5, the mandrel has been lifted vertically upward until the indicator means 62 has engaged the lower end of the seating or sealing nipple 36. At this position, a weight indicator above ground varifies that the mandrel has been moved into the bypass configuration, whereupon the cross-over port 47 communicates the casing annulus above the packer with the lower end 70 of the washpipe, so that gravel entrained fluid can flow down the tubing string, into the mandrel, through ports 56 and 24, and into the screen annulus, thereby packing gravel into the perforations and behind the screen. At the same time, the carrier fluid flows on through the screens 25, 26, into the concentric annulus 55, through ports 47 and into the casing annulus where the fluid then flows to the surface of the ground.

Figure 7:
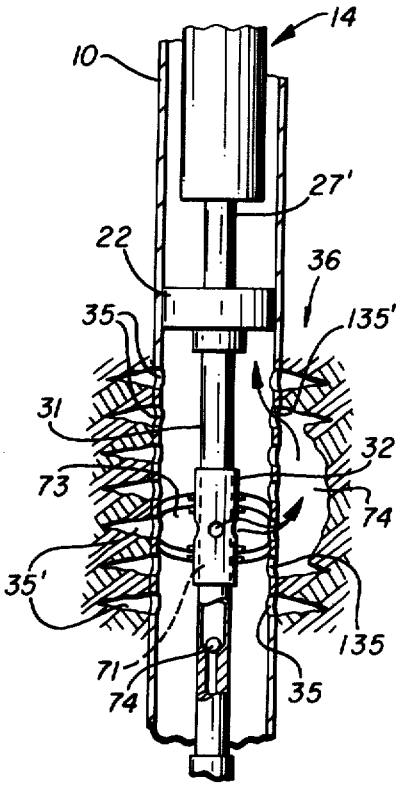
FIG. 7 is an enlarged detail of part of the apparatus disclosed in some of the foregoing figures.

In FIG. 7, the perforation washer has been placed with the ports 72 aligned to emit fluid into chamber 73 and into one of the perforations 135. Fluid pressure applied to the tubing string forces fluid at 71 to flow around behind the casing and back into an upper perforation 135', thereby washing out a cavity 74'. The cavity is subsequently filled with gravel during the gravel pack operation. The ball and seat at 75 must be of a configuration whereby the ball can be dropped through the sleeve 50 of FIG. 3.

FIGS. 8, 9, and 10 disclose an alternate embodiment of the invention. As seen in FIG. 8, tubing 18 is seated on cross-over 76. A safety valve nipple 78 is connected to tubing 79 which extends through a dual packer 120. Blanking plug 80 is sealingly received within a seating nipple 82 for preventing flow therethrough.

A key locating collar 84 is connected to a seating nipple 85. Tubing pack-off 86 is connected through screen 114 to a seating nipple 88. Centralizers 87 maintain the screen in properly spaced relationship respective to the casing.

A packer actuated vent assembly 128, preferably made in accordance with one of the before mentioned patents, is opened when the packer 122 is set. A bar, such as seen at 38 in FIG. 1, is dropped down the tubing string and travels through the upper packer, the screen assembly, the lower packer, and impacts against the gun firing head, thereby detonating the casing gun 116.

The packer 122 is unseated, the screen moved into the position of FIG. 9, and both packers set, thereby packing off the perforated zone with the screen being aligned at the perforations.

The blanking plug 80 is removed from its seat and tubing 94 substituted therefor so that the tubing is connected to the dual packer in the illustrated manner of FIG. 9. The tubing pack-off 86 is removed from the interior of the screen, and the blanking plug 90 placed within the seat 88, thereby precluding downhole flow through the lower packer. Gravel is flowed through tubing 94 into the annulus 96 about the screen, thereby gravel packing the perforated zone.

As seen in FIG. 10, the tubing 94 is removed and a blanking plug 80 is replaced in seat 82 so that production flows from the perforated zone, through the gravel pack, through the screen, and up through the tubing string 79, 18 to the surface of the earth.

Accordingly, FIG. 8 of the drawings illustrate the perforating position of the tool string; FIG. 9 illustrates the gravel pack position; while FIG. 10 illustrates the production position of the apparatus. The entire operation is carried out in a single trip into the borehole. All of the apparatus is left downhole as a permanent completion apparatus.

This invention, in its broadest concept, comprises running a tool string into a borehole. The tool string includes spaced packer means, with a screen means included therebetween. A casing perforating means is included in the tool string. Provision is made for above ground actuation of the perforating means; and, thereafter for flowing gravel down between the annulus formed between the screen and the perforated zone, while carrier fluid is returned up the casing annulus. Provision is also made for the flow of formation fluid from the perforations, through the gravel and screen, and uphole to the surface of the ground where the produced fluid is gathered in the usual manner. This concept enables a well to be permanently completed by making a single trip into the borehole.

Accordingly, it is contemplated that the perforating means can be located respective to the screen other than as shown in the drawing, while remaining within the comprehension of this invention.

Moreover, where a production tubing is employed as the tubing string, production can be achieved through the mandrel and into the tubing string. Alternatively, the mandrel can be retrieved and the production tubing connected to receive flow from the upper packer.

EXAMPLE I

A tubing string is run downhole within a cased borehole with a tool string attached to the lower end thereof. The tool string comprises a gravel pack tool of FIG. 3 and a high density jet perforating casing gun. The casing gun includes a firing head responsive to impact. The gravel pack tool includes a mechanically compression set packer at the lower end and a hydraulically set packer at the upper end thereof.

The gun is positioned as seen in FIG. 1. The bar is dropped from the surface, and fires the shaped charges of the gun. The tubing string is lowered until the packers straddle the perforated zone.

The lower packer is set. Ball 26 is dropped downhole onto the sleeve. Pressure is applied to the tubing string to set the upper packer. The pressure is subsequently increased to shear out the sleeve and move the sleeve to uncover port 56. The mandrel is positioned according to FIG. 5 and gravel admixed with water is circulated down the tubing string into the screen annulus while water is returned uphole through the casing annulus. After the proper amount of gravel has been translocated from the surface into the screen annulus, the mandrel is lifted into the illustrated position of FIG. 6, and reverse circulation of water employed to wash out the residual gravel.

The mandrel is removed from the borehole and the tubing string attached to the upper packer. The well is produced by flowing formation fluid through the gravel, screen, up the outer barrel, into the tubing string, and to the surface where the production is gathered in a conventional manner.

EXAMPLE II

A well is completed according to Example I, with the additional step of free flowing the well to ambient at the instant of forming the perforations, with flow occurring up the borehole about the entire tool string.

EXAMPLE III

A well is completed according to Example I, with the additional step of providing a packer actuated vent assembly 28. The mechanical set packer is actuated prior to firing the gun, thereby causing the vent assembly to be moved to the open position. After cleaning up the perforations by flowing into the vent assembly and uphole through the tubing string, the well is shut-in and the mechanical packer is reset at a lower elevation to position the screen near the perforations.

EXAMPLE IV

A well is completed as in each of the above examples, and prior to the gravel pack step, a well treatment is carried out by flowing treatment fluid down through the tubing string, through passageway 48, port 56, and into the perforations.

EXAMPLE V

A well is completed as in each of the above examples, with the additional step of washing out the perforations in accordance with FIG. 7 being included.

EXAMPLE VI

A well is completed as in each of the above examples, with the additional step of running a wireline downhole to the releasable coupling and dropping the lower marginal end of the tool string to the bottom of the borehole, after the step of perforating the well.

I claim:

1. Method of completing a pay zone located downhole in a cased borehole comprising the steps of:

assembling a tool string which includes a casing perforating means, a packer device, and a sand screen; and, running the tool string downhole into the borehole until the perforating means is positioned adjacent to the pay zone;

perforating the casing adjacent the pay zone by actuating the casing perforating means; and thereafter, positioning the sand screen adjacent to the perforated zone to form a screen annulus between the screen and casing, and packing off the upper and lower ends of the screen annulus with said packer device to thereby isolate the perforated zone;

forming a gravel flow path which extends from the surface downhole to the tool string and into the screen annulus; and a return flow path which extends from the screen back uphole to the surface of the ground;

admixing gravel with a fluid and flowing the mixture along said gravel flow path until the gravel is deposited within the screen annulus, and returning the fluid through the screen and along said return flow path to the surface of the ground;

and thereafter forming a production flow path from the screen to the surface of the ground so that produced fluid can flow from the perforations, through the gravel, through the screen, and uphole to the surface of the ground.

2. The method of claim 1, and further including the step of running the tool string downhole on the end of a tubing string;

carrying out the step of perforating the casing by forming a passageway which commences at the tubing string and extends concentrically through the screen annulus into communication with the perforating means;

using a jet perforating gun as the perforating means; and, firing the gun by extending a gun firing device down through the tubing string, through the passageway, and into contact with the perforating gun.

3. The method of claim 2, and further including the step of placing a gun firing head above said gun, placing said gun below said screen, and firing said gun by running a gun firing device down through the screen and packers and into contact with said gun firing head.

4. The method of claim 1 and further including the steps of:

using a jet perforating gun as the perforating means and running the tool string downhole on the end of a tubing string;

placing said packer device respective to the tool string such that there is a packer located above and below the perforated zone with the screen being located therebetween to form said screen annulus between the screen and casing; and, to form an annulus between the tubing string and casing;

forming a gun firing passageway which extends from the surface of the ground, through the tubing string, through the packers and concentrically through the screen, and to the gun; firing the gun by running a gun firing device down said passageway to carry out the perforating step;

forming said gravel flow path which extends down through the tubing string, through the upper packer, and into the screen annulus; and forming said return flow path from the inner surface of the screen, back up through the upper packer, and into the casing annulus, so that gravel admixed with fluid can be circulated downhole into the screen annulus where the gravel is retained within the screen annulus as the separated fluid flows through the screen and back up the casing annulus to the surface of the ground.

5. The method of claim 4 and further including the step of:

forming a vent between the perforating means and the lower packer, opening the vent prior to perforating the casing; forming a flow path which extends from the production zone, into the vent, axially up through the screen and packers; and flowing the well to the surface of the ground immediately upon perforating the casing to thereby clean up the perforation zone, and thereafter shutting in the well and carrying out the steps required for gravel packing the perforated borehole.

6. The method of claim 1 and further including the step of cleaning out the perforations prior to gravel packing by forming one flow path which extends downhole to the perforated zone and forming another flow path which extends from the perforated zone, uphole to the surface of the ground;

isolating at least one perforation from another perforation, and connecting said one perforation to said one flow path while connecting at least one other perforation to said another flow path;

circulating fluid down said one flow path, into said one perforation, into the pay zone, back through said another perforation, and into said another flow path to form a cavity within said pay zone so that gravel can subsequently be forced through a perforation and into said cavity during the gravel packing step.

7. The method of claim 1 and further including the steps of:

removably placing a mandrel axially within said screen, and connecting the interior of the mandrel to a tubing string and to a gun firing head so that the gun firing head can be actuated through the tubing string;

using a jet perforating gun for said perforating means, attaching said gun to said head;

firing the gun by passing a gun firing device through the tubing string and to said head; blocking off the mandrel passageway to the gun and forming said gravel flow path from the tubing string into the mandrel and from the mandrel into the screen annulus; forming said return flow path from the screen interior back up to the tubing annulus;

circulating gravel along the gravel flow path and into the screen annulus to thereby gravel pack the perforated zone; and, returning fluid which flows through the screen from the screen annulus along said return flow path and to the surface of the earth;

removing the mandrel from the gravel packing tool and attaching a production tubing to the tool;

flowing formation fluid from the perforations, through the gravel and screen, and up through the production tubing to the surface of the ground.

8. Method of perforating a cased borehole adjacent to a hydrocarbon containing formation and gravel packing the perforated zone in a single trip into the borehole comprising the steps of:

(1) assembling a tool string by attaching a casing perforating gun in series relationship respective to two spaced packer devices having a screen apparatus located therebetween;

(2) running the tool string downhole into the borehole on the end of a tubing string and positioning the gun adjacent to the hydrocarbon containing formation;

(3) perforating the casing by firing the gun;

(4) moving the tool string within the borehole until the spaced packers straddle the perforated zone;

(5) setting said packers thereby forming an annular area between the screen and casing;

(6) forming a flow path which extends down through the tubing string, into the annular area between the screen and casing, and from the screen back into the casing annulus located above said tool string;

(7) flowing a mixture of gravel and fluid along the flow path described in step (6) so that gravel is deposited within said annular area between the casing and the screen while fluid is returned into the casing annulus.

9. The method of claim 8 and further including the step of closing the flow path to the annular area and to the casing annulus; and, forming a produced fluid flow path which extends from said screen, up the tubing string, and to the surface of the ground so that production can occur from said formation, through the perforations, gravel, and screen, and up the last recited fluid flow path.

10. The method of claim 9 wherein step (3) is carried out according to the following steps:

forming an axial passageway which extends from the tubing string, through the packers and screen, and to the gun;

firing the gun by running a gun firing device down through the axial passageway and into the required operative relationship respective to the gun to cause the gun to fire and perforate the casing.

11. Method of completing a pay zone located downhole in a cased borehole comprising the steps of:

(1) running a tool string downhole into the borehole wherein the tool string includes a casing perforating device, a packer means, and a screen means;

(2) positioning the perforating device adjacent to a pay zone;

(3) actuating the perforating device, thereby communicating the interior of the casing with the pay zone;

(4) positioning the screen means adjacent to the pay zone by changing the elevation of the tool string respective to the surface of the ground; and, using the packer means to form an isolated screen annulus between the screen means and the perforated pay zone wherein the annulus is in flow communication with the perforated pay zone;

(5) forming a first flow path which extends from the surface of the ground down to the screen annulus, and a second flow path which extends from the screen means back uphole to the surface of the ground;

(6) flowing a fluid admixed with gravel down the first flow path to cause the gravel to be deposited within the screen annulus, while the separated fluid continues through the screen and up along the second flow path to the surface of the ground;

(7) producing the pay zone by forming a production flow path which extends from the perforations, through the gravel and screen, and uphole to the surface of the ground.

12. The method of claim 11 wherein step (3) is carried out by positioning said perforation device below said packer means in spaced relationship respective to said screen means;

forming a passageway which extends from the surface of the ground, down through said screen means and said packer means, and to said perforation device;

running a means for actuating the perforating device down through the last recited passageway and into operative relationship respective to the perforating device, thereby causing the device to perforate the casing.

13. In a cased borehole having a pay zone located downhole therein and separated from the interior of the borehole by the casing; the combination with the cased borehole of a tool string for completing and producing the borehole;

said tool string includes a packer means, a string of tubing, a main body having a gravel screen formed therein, and a perforating gun means;

said packer means, gravel screen, and perforating gun means being supported from said string of tubing and positioned in axial aligned series relationship respective to one another;

said packer means being located above and below said screen means and positioned to pack off an annular area between the screen and the casing;

a mandrel telescopingly received within said main body;

means forming a gun firing passageway which extends from said tubing string, through said mandrel, and to said gun means;

means by which said mandrel can form a gravel flow passageway which extends from said tubing string, through a marginal length of said mandrel, and into said screen annulus;

means by which said mandrel can form a return fluid passageway from said screen to the annular area between the casing and tubing string;

and means associated with said tubing string and main body for forming a production flow passageway which extends from said screen annulus into said tubing string.

14. Method of completing a formation located downhole in a cased borehole, comprising the steps of:

(1) communicating the formation with the interior of the casing by perforating the casing with a casing perforating means thereby forming a perforated zone; and thereafter (2) isolating the perforated zone by straddling the perforated area of the interior of the casing with a packer means, and placing a screen means between the packers, thereby providing an annular area between the exterior of the screen means and the interior of the perforated casing; and thereafter (3) forming a first flow path which extends from the surface of the ground, downhole into the annular area along which gravel can flow; and, forming a second flow path which extends through the screen, uphole to the surface of the earth; and, flowing gravel admixed with a fluid along the first flow path and returning the fluid along the second flow path; and thereafter (4) producing the formation by forming a flow path which extends from the formation, through the perforations, gravel, screen, and uphole to the surface of the ground.

15. The method of claim 14 and further including the steps of:

(5) carrying out step (1) by forming a passageway which extends from the surface of the ground downhole to the casing perforating means and running a device through the passageway into proximity of the casing perforating means to actuate the perforating means;

(6) closing the passageway before carrying out step (3); and closing the first and second flow path before carrying out step (4).

16. The method of claim 15 and further including the step of using a high density jet perforating casing gun for the perforating means;

using a gun firing head for detonating the shaped charges of the gun;

causing said gun head to detonate the charges by passing a weight down through the passageway and into contact with the gun firing head.

17. The method of claim 15 and further including the step of using a dual packer as the uppermost packer and another packer as the lowermost packer;

connecting the interior of the screen to one of the strings associated with the dual packer, and connecting the annular area to the other of the strings associated with the dual packer.

18. Apparatus for perforating and gravel packing a cased borehole on a single trip into the well comprising:

a pipe string;

a gravel packing tool suspended on the pipe string, said gravel packing tool including means for conducting gravel flowing down said pipe string into the cased borehole;

a perforating gun suspended on the pipe string below said gravel packing tool;

means defining a passageway extending from said perforating gun through said gravel packing tool and pipe string for accomodating means for actuating said perforating gun and for gravel packing the well, and means defining a return path from said gravel packing tool to the surface for the return of gravel packing fluids.

19. The apparatus of claim 18 and including a releasable coupling disposed between said gravel packing tool and said perforating gun for releasing said perforating gun from the pipe string.

20. The apparatus of claim 18 and including a vent assembly disposed above said perforating gun for opening said passageway to the flow of production fluids.

21. The apparatus of claim 21 and including a packer for sealing the cased borehole with respect to said gravel packing tool and for actuating said vent assembly upon setting said packer in the sealing position.

22. The apparatus of claim 18 wherein said perforating gun includes a firing head disposed in said passageway for engagement with actuation means passed through said passageway to actuate said perforating gun.

23. The apparatus of claim 18 wherein said perforating gun includes shaped charges for creating perforations of a size to pass gravel from said gravel packing tool into the formation of the well.

24. The apparatus of claim 18 wherein said perforating gun has a horizontal cross section greater than that of the pipe string.

25. The apparatus of claim 18 and including means for sealing the cased borehole above and below said gravel packing tool.

26. The apparatus of claim 18 wherein said gravel packing tool includes a screen for the return of the carrier fluid and for the flow of production fluids.

27. The apparatus of claim 18 and including a packer for sealing the annulus between the cased borehole and said gravel packing tool.

28. The apparatus of claim 27 wherein said gravel packing tool includes port means for circulating gravel in a carrier fluid through a portion of said passageway and through said port means into the cased borehole around said gravel packing tool and below said packer, and means forming a return path non-communicative with said passageway portion for flowing said carrier fluid from the cased borehole below said packer to the cased borehole around the pipe string above said packer.

29. The apparatus of claim 28 and including means for closing said port means to gravel flow and said return path to carrier fluid flow to form a production flow path for the production fluids in the well.

30. The apparatus of claim 27 wherein said gravel packing tool includes:

a housing having port means and screen means below said port means;

a mandrel telescopingly received within said housing and having aperture means communicating with said port means, said passageway passing through said mandrel with said aperture means communicating said passageway with the exterior of said mandrel whereby gravel with a carrier fluid may flow from said passageway and through said port means to the exterior of said housing;

means for sealing the upper end of said housing with said mandrel;

sleeve means reciprocably received within said mandrel for closing said aperture means and therefore said port means to flow from said passageway in a first position;

means for releasing said sleeve means and reciprocating said sleeve means from said first position to a second position for closing said passageway below said aperture means and opening said aperture means and therefore said port means to flow from said passageway;

means forming a return flow path through said mandrel non-communicative with said passageway in the second position and communicating said screen means with the annulus above the packer for the return flow of the carrier fluid; and means for sealing said housing and said mandrel below said port means and aperture means.

31. The apparatus of claim 30 and including means for releasing said mandrel from said housing upon rotation of the pipe string to raise said mandrel within said housing to communicate said return path with the annulus above said packer.

32. The apparatus of claim 30 and including means for indicating the location of said mandrel within said housing.

33. The apparatus of claim 18 wherein said gravel packing tool includes:

a housing having ports communicating the interior of said housing with the adjacent cased borehole and having a screened portion;

packer means above said ports for sealing the annulus between said housing and the cased borehole;

a conduit having a portion thereof disposed in said housing, said passageway passing through said conduit, said conduit having first aperture means communicating said passageway with said ports; and said conduit being movable within said housing between a perforating position, a treating position, a gravel packing position, and a cleaning position.

34. The apparatus of claim 33 wherein said conduit further includes means forming a return flow passage, second apertures communicating said return flow passage with the exterior of said conduit, and vent means for closing said first apertures in said perforating position and for opening said first apertures and closing said passageway below said first apertures in said treating, gravel packing, and cleaning positions.

35. The apparatus of claim 34 wherein said gravel packing tool further includes:

first seal means for sealing said housing and conduit above said ports in said perforating and treating positions;

second seal means for sealing said housing and conduit below said second aperture means in said gravel packing position; and third seal means for sealing said housing and conduit below said ports in said perforating, treating and gravel packing positions and above said ports in said cleaning position.

36. The apparatus of claim 34 wherein said gravel packing tool further includes releasable connection means for connecting said conduit to said housing in said perforating and treating positions and releasing said conduit from said housing in said gravel packing and cleaning positions whereby in the perforating position, a bar may be passed through said passageway and said gravel packing tool, in the treating position, fluids may flow through said passageway and out through said ports into said perforations without return flow, in the gravel packing position, gravel in a carrier fluid may flow through said passageway and out through said ports into said perforations and the carrier fluid may return through said return flow passage and into the annulus of the cased borehole above said packer means, and in the cleaning position, fluid may be circulated down the annulus of the cased borehole above said packer means through said first apertures and up said passageway without flow into said housing.

37. The apparatus of claim 18 with a second string of pipe extending into the well, and including:

a dual packer disposed on the first pipe string above said gravel packing tool and receiving the lower end of the second pipe string;

first plug means for plugging the second pipe string during perforation and production;

packing means for packing off said passageway through the interior of said gravel packing tool during perforation;

a single packer disposed below said gravel packing tool;

means for removing said first plug means and said packing means after perforation;

means for locating said gravel packing tool near the formation of the well after perforation;

second plug means for plugging said passageway below said gravel packing tool after perforation; and means for causing said first plug means to plug the second pipe string after gravel packing.

38. A tool string suspended on a single pipe string within a cased borehole for completing a pay zone located downhole in a single trip, comprising:

a screen means suspended on the pipe string for screening the production from the pay zone;

perforating means suspended on the pipe string for perforating the cased borehole;

means for actuating said perforating means;

means suspended from said pipe string forming a gravel passageway for conducting gravel flowing down said pipe string into the cased borehole surrounding said screen means; and means suspended from said pipe string forming a return passageway extending from said screen means to the surface.

39. The tool string of claim 38 and including packer means disposed above said screen means for packing off the annulus formed by the cased borehole and pipe string.

40. The tool string of claim 39 and including means for opening an annulus passageway to communicate said return passageway with the annulus above said packer means.

41. The tool string of claim 38 and including packer means disposed below said screen means.

42. Method of completing a well, comprising lowering into a cased wellbore on a single string of tubing gravel packing means including screen means and perforating means, perforating the well by actuating the perforating means, flowing gravel down through the tubing string, through the gravel packing means and into the cased wellbore surrounding the screen means, and flowing produced fluid from the perforations through the gravel, through the screen, and uphole to the surface of the ground.

43. Method as defined by claim 42 and including packing off the wellbore above and below the screen means to isolate the perforated zone.

* * * * *